United States Patent [19]

Pigeon

[11] 4,222,202

[45] Sep. 16, 1980

[54] AUTOMOTIVE TAPE DRIVE WINDOW REGULATOR

[75] Inventor: Dale W. Pigeon, Royal Oak, Mich.

[73] Assignee: General Motors Corporation, Detroit, Mich.

[21] Appl. No.: 960,737

[22] Filed: Nov. 15, 1978

[51] Int. Cl.[2] ..... E05F 11/48

[52] U.S. Cl. ..... 49/352; 49/375

[58] Field of Search ..... 49/41, 352, 348, 341, 49/375

[56] References Cited

U.S. PATENT DOCUMENTS

| | | | |
|---|---|---|---|
| 3,897,654 | 8/1975 | Kouth et al. | 49/352 |
| 4,004,371 | 1/1977 | Podolan et al. | 49/352 |

*Primary Examiner*—Kenneth Downey

*Attorney, Agent, or Firm*—R. L. Phillips

[57] ABSTRACT

A connector device for attaching the tape in an automotive window regulator to the window comprising a drive block which engages the tape and snap locks to a guide block which also retains the drive block in engagement with the tape, and a sash plate which is fixable to the window and twist locks to the guide block.

4 Claims, 7 Drawing Figures

AUTOMOTIVE TAPE DRIVE WINDOW REGULATOR

This invention relates to an automotive tape drive window regulator and more particularly to a connector device for attaching the tape in such a regulator to the window.

Automotive tape drive window regulators have certain advantages over the linkage type such as in cost, weight, and space savings and simplicity of manufacture and assembly. The present invention is directed to furthering certain of these advantages and particularly as to the manner in which the tape is connected to the window. This connection can be accomplished with several brackets and threaded fasteners but this requires considerable assembly time in addition to the many parts.

According to the present invention, this connection is simply, positively, and inexpensively provided by the cooperative relation of a drive block, guide block and sash plate. The guide block is guided on the normal tape track and snap locks to the drive block which is engaged by the tape. The guide block retains the drive block in engagement with the tape and also twist locks to the sash plate that is fixed to the bottom of the window. The guide block, drive block and sash plate all have simple shapes which can be molded in tough plastic and in addition, the overall size and weight of the tape and window connection is small. Furthermore, the assembly time is very short since no threaded fasteners are required and instead all the parts interlock and this together with their simplified manufacture provides a significant advance in the automotive tape drive window regulator art.

These and other objects of the present invention will be more apparent from the following description and drawing in which.

Figure 1:
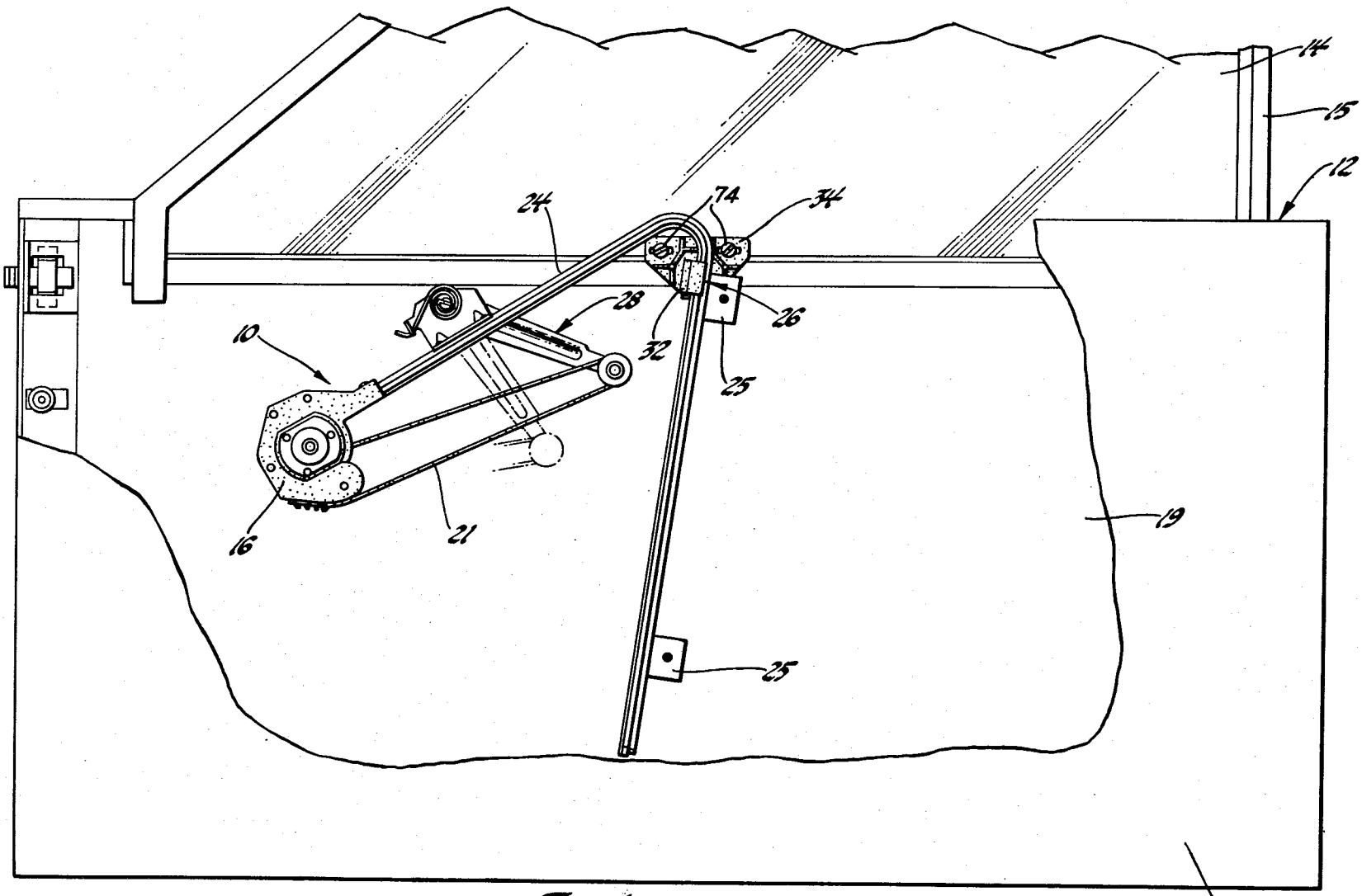
FIG. 1 is a side view of an automotive door with the inner panel broken away to illustrate a window regulator having a connector device between the tape and window according to the present invention.

The invention is shown in use in an automotive window regulator 10 of the type disclosed in U.S. Pat. Application Ser. No. 921,729 filed July 3, 1978, now U.S. Pat. No. 4,174,865, in the name of Juozas Doveinis and assigned to the assignee of this invention and which is hereby incorporated by reference. The window regulator 10 is mounted in an automotive door 12 and is operable to open and close a window pane 14 with respect to a window opening defined by the belt line of the door and the vehicle body, not shown. The window has a frame 15 by which it is guided in the door and the window regulator 10 generally comprises an actuator 16 which is mounted between the door's inner and outer panels 18 and 19 in the forward half thereof and with the actuator fixed to the inner panel.

The actuator includes a sprocket 20 which engages and drives a perforated plastic tape 21 that is slidably mounted in a channel track 24 that is fixed to the inner door panel 18 at the actuator 16 and by a pair of brackets 25. The tape 21 is connected to the window 14 at a midpoint near the bottom edge thereof by a connector device 26 according to the present invention. A swing arm counterbalance device 28 operatively connected to the tape maintains the latter taut and counterbalances the weight of the window as it is moved by operation of the actuator 16. The structure thus far described except for portions of the connector device 26 is disclosed and described in detail in the aforementioned Doveinis application to which reference may be made for a more complete understanding thereof.

Referring to FIGS. 3 through 7, the connector device between the tape and the window comprises three interlocking parts; namely, a drive block 30, guide block 32 and sash plate 34. All these connector parts are molded hard plastic one-piece parts and interlock so as to be positively connected without need of any threaded fasteners and the like. The drive block 30 has parallel flat sides 35 extending through the open side of the channel track 24 and one or more projections 36, in this case four, projecting from an inwardly facing side 37 thereof which engage the perforated tape 21. An outwardly facing side 38 of the drive block 30 opposite the inwardly facing side 37 has a resilient locking arm 39 projecting outward and downward therefrom and in addition, has a projecting foot 40 on the same side opposite the end of the arm. The guide block 32 has a longitudinal opening 41 in one side thereof to a longitudinal slide channel 42 parallel therewith having a pair of oppositely facing slots 43 for slidably mounting the guide block on the outside of the channel track 24. In addition, the guide block 32 has a longitudinal locking channel 44 which is open and parallel to the slide channel 42 and closely receives the flat sides 35 of the drive block 30 while the latter is engaged with the tape. The guide block 32 is also formed with a pair of transversely extending wall portions 46 and 48 which extend across opposite ends of the locking channel 44 to provide detents for the locking arm 39. The lower detent wall 46 has a surface 49 forming a projecting portion on the back of the locking channel which is engaged by and deflects the locking arm 39 as the drive block 30, while engaging the tape 21, is moved upward as viewed in FIG. 4 into the locking channel 44 by pushing on the drive block foot 40 after the guide block 32 has been slidably mounted on the channel track 24. The detent walls 46 and 48 have oppositely facing sides 52 and 53, respectively, which are spaced apart a distance slightly longer than the length of the locking arm 39 so that as the drive block is continued to be pushed upward with its thus deflected arm, the locking arm eventually snaps into the space past the detent 46 between the detent sides 52 and 53 and is thus captured in the locking channel 44. The detent wall 48 whose side 53 faces the base 54 of the locking arm 39 also has a side 55 which is engaged by the side 38 of the drive block 30 to hold its projections 36 engaged with the tape with the cooperation of the detent side 49 at the other end of the guide block. Thus, the guide block 32 and drive block 30 are fixedly non-pivotally interconnected and the drive block is also retained in engagement with the tape.

Figure 2:
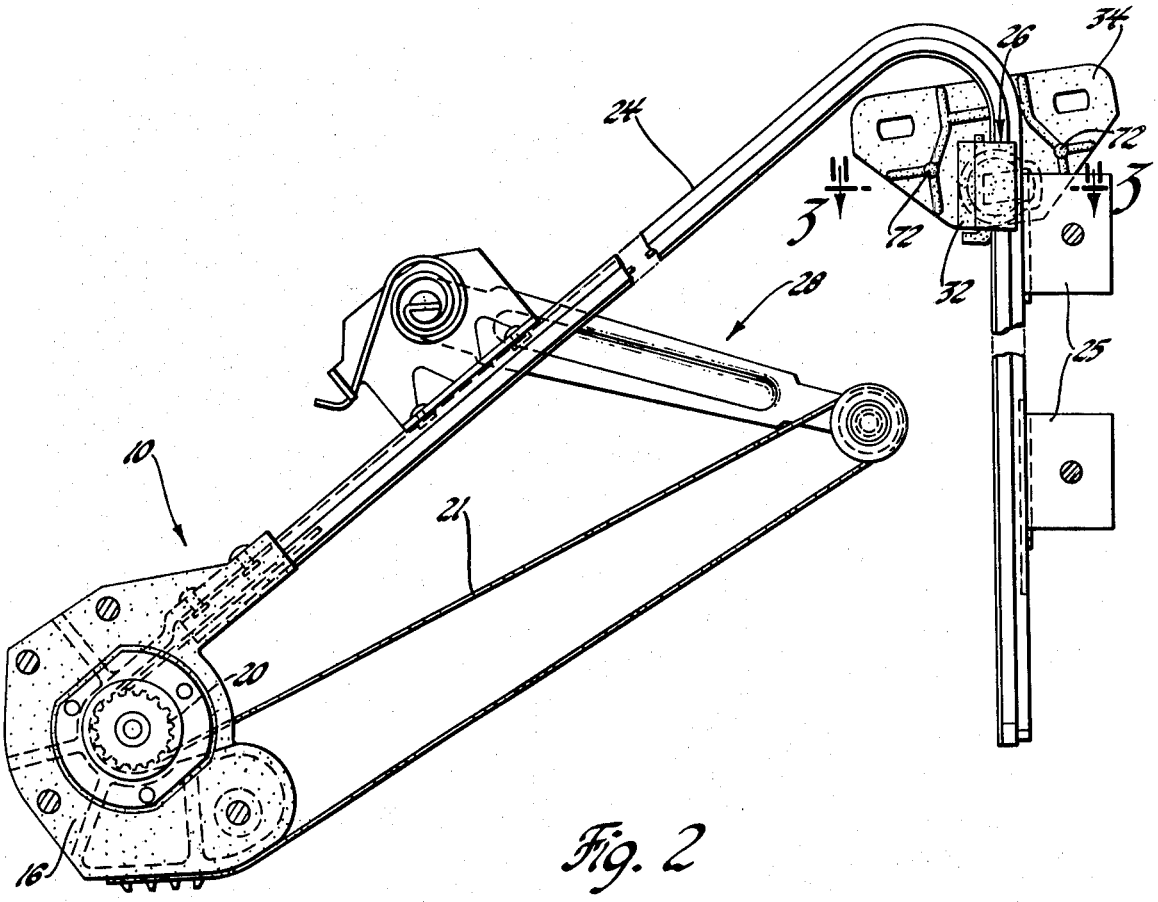
FIG. 2 is an enlarged view of the window regulator in FIG. 1.
Figure 3:
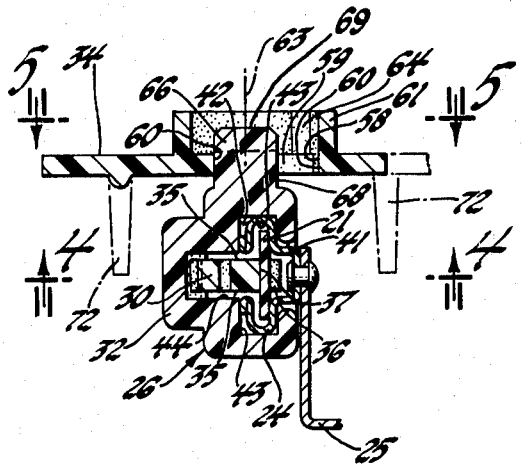
FIG. 3 is an enlarged view of the connector device taken along the line 3—3 in FIG. 2.
Figure 4:
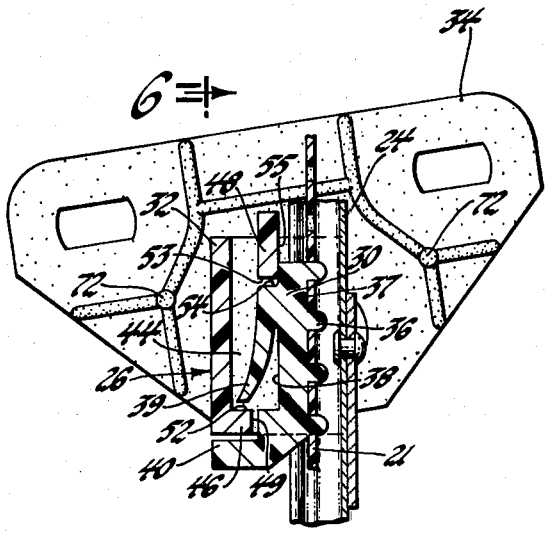
FIG. 4 is a view taken along the line 4—4 in FIG. 3.
Figure 5:
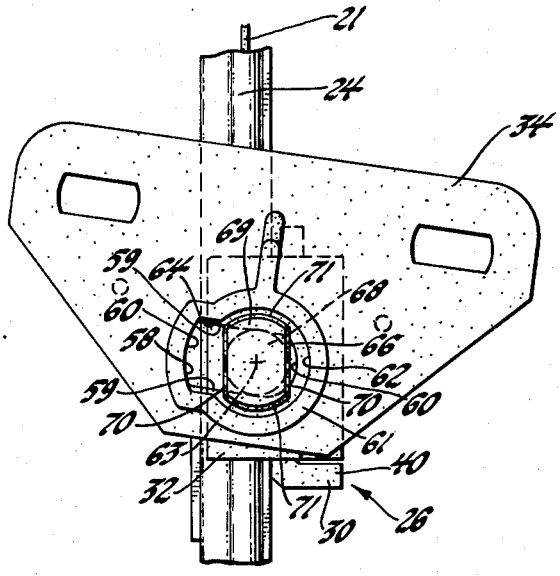
FIG. 5 is a view taken along the line 5—5 in FIG. 3.
Figure 6:
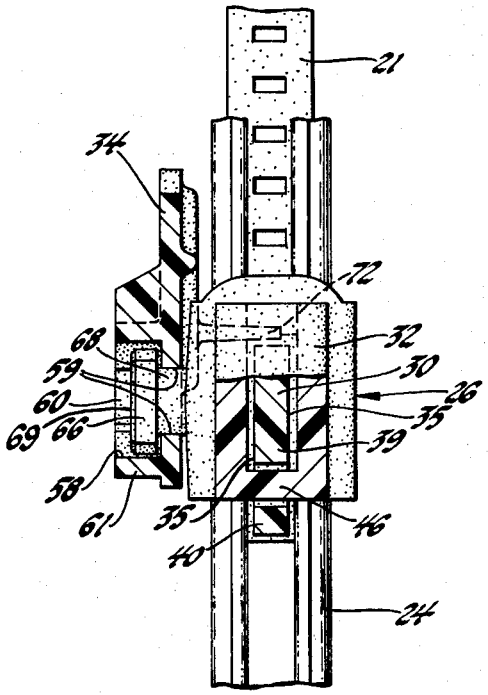
FIG. 6 is a view taken along the line 6—6 in FIG. 4.
Figure 7:
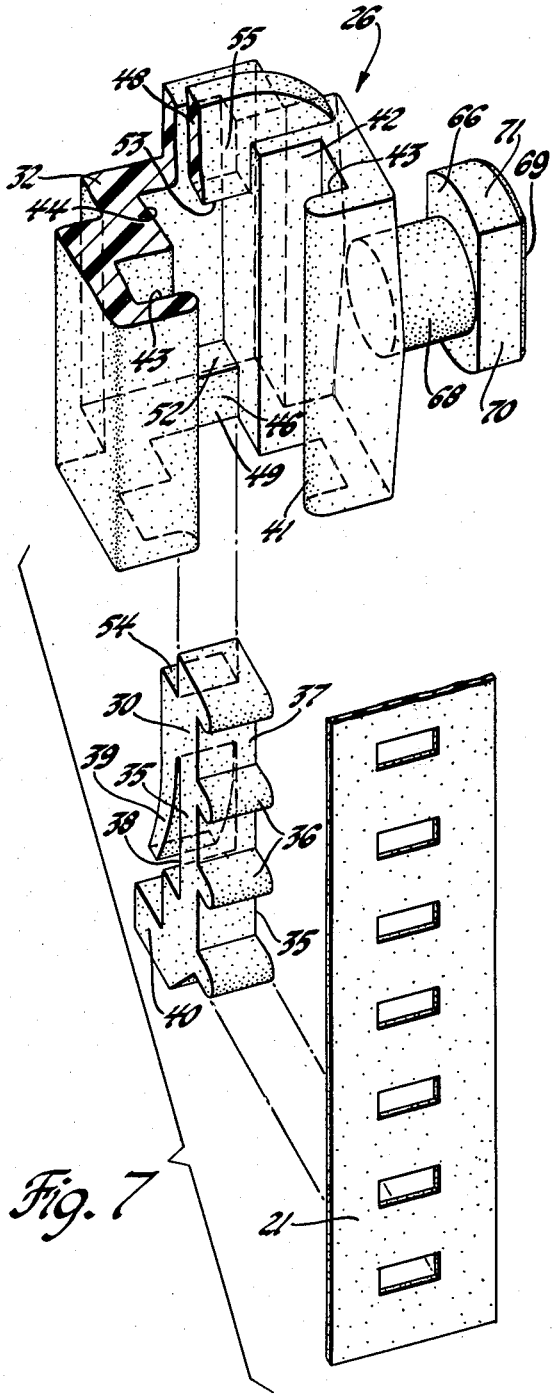
FIG. 7 is an exploded view of the connector device in the above figures.

As shown in FIGS. 3, 5, and 6, the sash plate 34 has a slot 58 with a generally rectangular shape having parallel long flat sides 59 and cylindrical short concave sides 60. In addition, the sash plate is provided on one side with a projecting key-hole shaped collar 61 bordering the slot 58 having a cylindrical portion 62 with a center 63 centered with respect to one end of the slot and also having a slot portion 64 which is co-extensive with the other end of the slot. The guide block 32 has a T-shaped projection 66 comprising a cylindrical portion 68 and a pivot head 69 with flat sides 70 and cylindrical end portions 71 having a cross-section which conforms to that of the sash plate slot 58. The T-shaped projection 66 is insertable through the sash plate slot 58 from the side opposite the collar 61 and the sash plate 34 is then transversely movable relative to the T-shaped projection to align the center of the pivot head 69 with the center 63 of the cylindrical collar portion 62 whereupon the guide and sash parts are then turned or pivoted 90° relative to each other to thereafter provide interlocking therebetween by the long flat sides 70 of the pivot head being transverse to the long sides 59 of the sash plate slot while the cylindrical portions 71 are then pivotal about the center 63 in the cylindrical collar portion 62. In addition, a pair of projections 72 as best shown in FIGS. 2, 3 and 4 are formed on the sash plate in locations to extend on opposite sides of the channel track 24 with the sash plate assembled to the guide block to thereby limit pivoting of the sash plate relative to the guide block to prevent their disengagement prior to assembly of the sash plate to the window by conventional fasteners 74 as shown in FIG. 1.

Thus, the guide block and drive block are fixedly non-pivotally interlocked or interconnected with a snap-together connection which also retains engagement of the drive block with the tape while the guide block and sash plate are fixedly pivotally interlocked or interconnected by a twist lock connection with the latter interlock retained by cooperation of the sash plate with the channel track as a subassembly prior to connection of the sash plate to the window. As a result, very little time is required in connecting the regulator tape to the window. In addition, the interlocking means on the drive block, guide block and sash plate are all simple structures which permit these parts to each be easily molded in one-piece and thus readily suited for mass production.

The above described embodiment is illustrative of the invention which may be modified within the scope of the appended claims.

The embodiments of the invention in which an exclusive property or privilege is claimed are defined as follows:

1. In a tape drive window regulator mechanism having a perforated tape slidably mounted in a fixed channel track for opening and closing a window, the improvement comprising a drive block and guide block and sash plate for cooperatively connecting the tape and window, said drive block having one or more projections for engaging the perforated tape, said guide block having channel means for slidably mounting the guide block on the outside of the channel track, said guide block and said drive block having interlocking means for fixedly interlocking same while also retaining the drive block in engagement with the tape, said sash plate having means by which it is fixed to the window, and said guide block and said sash plate having interlocking means for interconnecting same.

2. In a tape drive window regulator mechanism having a perforated tape slidably mounted in a fixed channel track for opening and closing a window, the improvement comprising a drive block and guide block and sash plate for cooperatively drivingly connecting the tape and window, said drive block having one or more projections for engaging the perforated tape, said drive block further having a resilient locking arm projecting therefrom, said guide block having first channel means for slidably mounting the guide block on the outside of the channel track and second channel means receiving the drive block and deflecting its locking arm during such reception, said second channel means having spaced detent means between which the deflected locking arm unbends and is thereby captured whereby the guide block and drive block are fixedly interconnected and the drive block is retained in engagement with the tape, said sash plate having means by which it is fixed to the window, and said guide block and said sash plate having interlocking means for interconnecting same.

3. In a tape drive window regulator mechanism having a perforated tape slidably mounted in a fixed channel track for opening and closing a window, the improvement comprising a drive block and guide block and sash plate for cooperatively connecting the tape and window, said drive block having one or more projections for engaging the perforated tape, said drive block further having a resilient locking arm projecting therefrom, said guide block having first channel means for slidably mounting the guide block on the outside of the channel track and second channel means receiving the drive block and deflecting its locking arm during such reception, said second channel means having spaced detent means between which the deflected locking arm unbends and is thereby captured whereby the guide block and drive block are fixedly non-pivotally interconnected and the drive block is retained in engagement with the tape, said sash plate having means by which it is fixed to the window, and said guide block and said sash plate having interlocking pivot means for fixedly pivotally interconnecting same.

4. In a tape drive window regulator mechanism having a perforated tape slidably mounted in a fixed channel track for opening and closing a window, the improvement comprising a drive block and guide block and sash plate for cooperatively connecting the tape and window, said drive block having one or more projections for engaging the perforated tape, said drive block further having a resilient locking arm projecting therefrom, said guide block having first channel means for slidably mounting the guide block on the outside of the channel track and second channel means for receiving the drive block and deflecting its locking arm during such reception, said second channel means having spaced detent means between which the deflected locking arm unbends and is thereby captured whereby the guide block and drive block are fixedly nonpivotally interconnected and the drive block is retained in engagement with the tape, said sash plate having means by which it is fixed to the window, and said guide block and said sash plate having interlocking pivot pin and slot means respectively for cooperatively fixedly pivotally interconnecting same.

* * * * *